US006179187B1

(12) United States Patent
Lemire et al.

(10) Patent No.: US 6,179,187 B1
(45) Date of Patent: Jan. 30, 2001

(54) ERGONOMICALLY ENHANCED BACKPACK

(76) Inventors: Mark L. Lemire, 1792 Troy La., Oceanside, CA (US) 92054; Steven F. Knight, 2351 5th St., Olivenhain, CA (US) 92024

( * ) Notice: Under 35 U.S.C. 154(b), the term of this patent shall be extended for 0 days.

(21) Appl. No.: 09/349,223

(22) Filed: Jul. 7, 1999

(51) Int. Cl.[7] ..... A45F 3/04; A45F 3/14

(52) U.S. Cl. ..... 224/640; 224/628; 224/631; 224/644; 224/645; 224/153; 224/578

(58) Field of Search ..... 224/153, 627, 224/628, 629, 631, 637, 641, 642, 644, 645, 651, 652, 578–583, 261, 262, 263, 640

(56) References Cited

U.S. PATENT DOCUMENTS

| | | | | |
|---|---|---|---|---|
| 2,667,996 | * | 2/1954 | Fanelli | 224/153 |
| 3,233,803 | * | 2/1966 | Gray | 224/581 X |
| 3,797,718 | | 3/1974 | Plant . | |
| 4,015,759 | | 4/1977 | Dreissignacker et al. . | |
| 4,223,819 | * | 9/1980 | Wright | 224/153 |
| 4,466,124 | * | 8/1984 | Kirkham, Jr. | 224/153 X |
| 4,506,769 | | 3/1985 | Franco et al. | 190/108 |
| 4,593,841 | * | 6/1986 | Lange | 224/153 |
| 5,004,135 | | 4/1991 | Dufournet et al. . | |
| 5,131,576 | * | 7/1992 | Turnipseed | 224/628 X |
| 5,167,600 | | 12/1992 | Baird | 482/105 |
| 5,184,763 | | 2/1993 | Blaisdell et al. . | |
| 5,228,609 | * | 7/1993 | Gregory | 224/644 X |
| 5,236,112 | | 8/1993 | Robinson et al. . | |
| 5,240,159 | | 8/1993 | Gregory . | |
| 5,529,228 | | 6/1996 | Biagi . | |
| 5,564,612 | | 10/1996 | Gregory | 224/633 |
| 5,577,648 | * | 11/1996 | Sason et al. | 224/637 |
| 5,630,537 | | 5/1997 | Sciacca | 224/629 |
| 5,634,576 | * | 6/1997 | Arbel | 224/153 |
| 5,743,447 | * | 4/1998 | McDermott | 224/153 |
| 5,779,121 | | 7/1998 | Capwell | 224/655 |
| 5,806,740 | | 9/1998 | Carlson | 224/628 |
| 5,819,998 | | 10/1998 | Chehebar | 224/153 |
| 5,826,771 | | 10/1998 | Peng | 224/651 |
| 5,890,640 | | 4/1999 | Thompson | 224/630 |
| 5,927,575 | * | 7/1993 | Gatling | 224/153 |
| 5,954,253 | * | 9/1999 | Swetish | 224/628 X |
| 5,984,157 | * | 11/1999 | Swetish | 224/631 |
| 6,024,265 | * | 2/2000 | Clements | 224/627 X |

* cited by examiner

*Primary Examiner*—Gregory M. Vidovich
(74) *Attorney, Agent, or Firm*—Henri J. A. Charmasson; John D. Buchaca

(57) ABSTRACT

An ergonomically enhanced backpack comprises a frame having a semi-rigid dorsal plate contoured to the shape of the lumbar region. The dorsal plate is secured to the body by a combination of shoulder straps and waist belt. An expandable cargo compartment is behind the dorsal mounted plate and sandwiched between the dorsal plate and a panel or netting. Drawstrings combined with the belt allow the user to pull the panel or netting toward the dorsal plate, and thus compress the load against the lumbar area closer to the body's center of gravity. In the first embodiment, that panel has a hinged door giving access to the cargo compartment. A detachable, soft shell bag is mounted over the cargo compartment.

4 Claims, 2 Drawing Sheets

ERGONOMICALLY ENHANCED BACKPACK

FIELD OF THE INVENTION

This invention relates to utility bags, and more specifically to knapsacks, also called backpacks which are engineered for carrying relatively heavy loads on the back of the user.

BACKGROUND OF THE INVENTION

The ability of hikers, mountaineers, or other outdoors enthusiasts to carry heavy loads in their knapsacks with relative ease depends in great part upon the placement of the burden or load in relation to the body and its distribution over the shoulders, hips and lumbar area of the user. In theory, the most efficient load placement would be immediately above the human body center of gravity, i.e., the center of the pelvis. Moreover, in order to minimize pressure against the body tissues, the load-bearing area of the knapsack should be spread widely over the contacting area of the body. Knapsacks of the prior art have addressed the latter issue by securing the lower part of the knapsack to a relatively wide belt that spreads the load around the waist. A specimen of this type of knapsack is disclosed in U.S. Pat. No. 4,015,759 Dreissigacker et al. The former issue of weight distribution has been addressed by providing shallow, but very high, knapsacks which distribute the weight over relatively small horizontal footprint and not too far from the spine. Examples of those narrow knapsacks are illustrated in U.S. Pat. No. 5,806,740 Carlson, and U.S. Pat. No. 5,240,159 Gregory. Tall knapsacks are rather unwieldy and impractical. Each item of their contents must be packed on top or below another. In order to remove an item near the bottom of the bag, every other item above it has to be taken out. Another disadvantage associated with tall knapsacks, is that they shift the center of gravity of the combined body and bag quite high which may cause the user to lose his balance when leaning forward, backward or sideways.

The instant invention results from a methodical attempt to resolve the above disadvantages of the knapsacks of the prior art.

SUMMARY OF THE INVENTION

The principal and secondary objects of this invention are to provide a knapsack or backpack that can carry a heavy load with minimal discomfort and improved stability, allowing the user a large freedom of movement and the ability to lean in any direction without loss of balance. It is also an object of this invention to provide a knapsack or backpack with broad dimensions and easy access for stowing and retrieving items therein.

These and other valuable objects are achieved by a knapsack whose main structural element is a dorsal plate contoured to the lumbar area of the body, and is equipped with a strapping assembly which allows the wearer to shift the load within an expandable envelope toward the dorsal plate, and corollarily toward the body center of gravity. The strapping assembly comprises sets of strings which are adjustably laced between the dorsal plate and the back panel of the bag.

DESCRIPTION OF THE PREFERRED EMBODIMENT OF THE INVENTION

Figure 1:
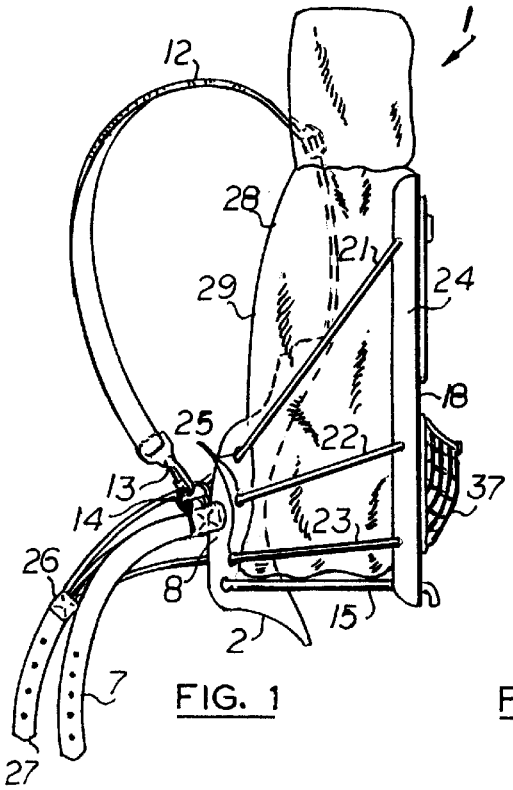
FIG. 1 is a side elevational view of a knapsack according to the invention.
Figure 2:
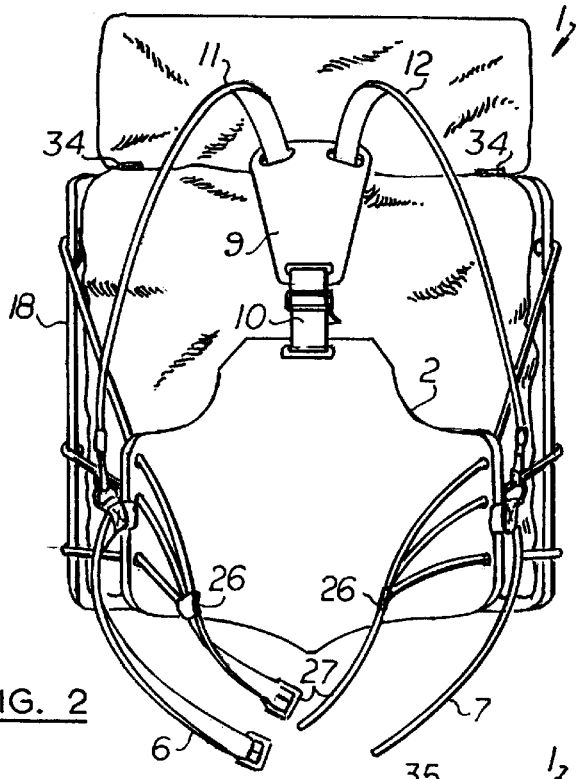
FIG. 2 is a front elevational view thereof.
Figure 3:
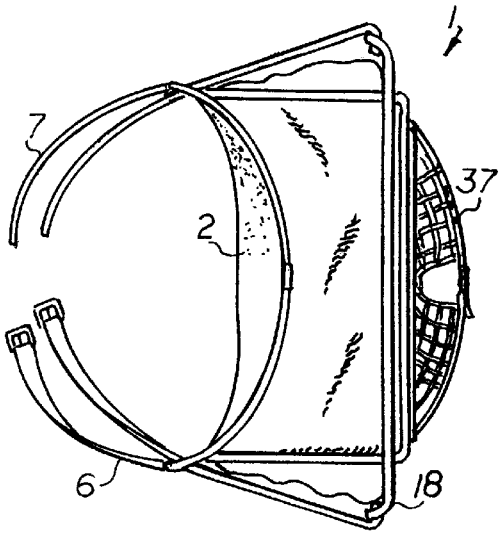
FIG. 3 is a bottom plan view thereof.
Figure 4:
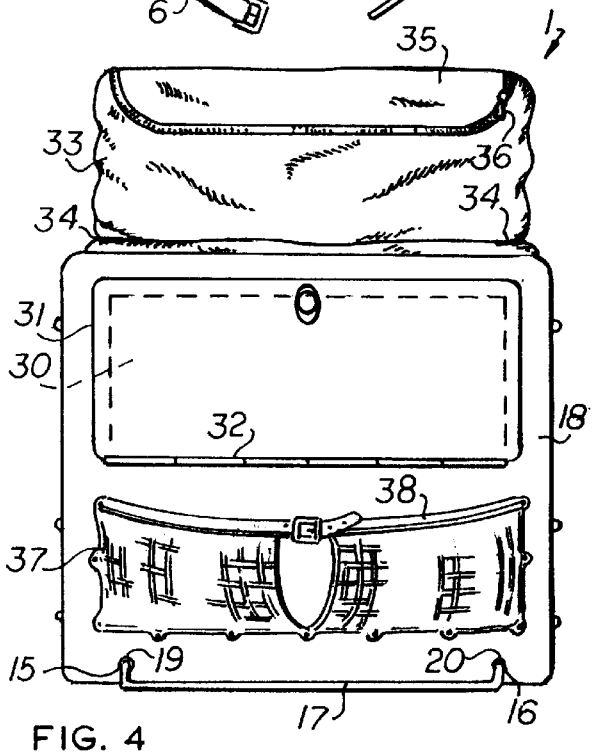
FIG. 4 is a back elevational view thereof.
Figure 6:
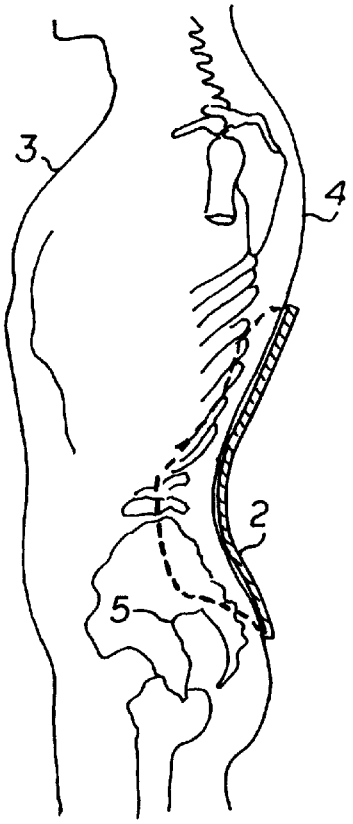
FIG. 6 is a cross-sectional view of the dorsal plate over a human silhouette.
Figure 5:
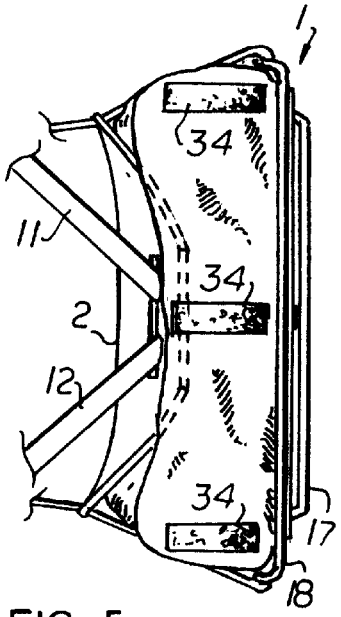
FIG. 5 is a top plan view thereof without the auxiliary containers.

Referring now to the drawing, there is shown in FIGS. 1–5 a knapsack 1 whose main frame or structural element is a dorsal plate 2 which is shaped and dimensioned to intimately contact the lumbar area of a user 3 from below the shoulder plate region 4 to the pelvic region 5 as illustrated in FIG. 6. The dorsal plate is made from a hard but flexible synthetic material so that it can be adjustably strapped on the body by a waist-level belt assembly comprising two cooperating straps 6 and 7 each being attached at one end to a median lateral area 8 of the dorsal plate 2. The dorsal plate is horizontally arcuate. In its rest state it is slightly more open or broader than the user's lumbar area. It is only when the belt assembly is cinched around the waist that the flexible dorsal plate closes tightly around the body. A flat, triangular yoke 9 attached to the median upper edge of the dorsal plate by a flexible and adjustable strap 10 provides an anchor for two shoulder straps 11 and 12. The distal ends of the shoulder straps are provided with locking hook assemblies 13 for convenient attachment to D-rings 14 secured to the root of each waist belt strap 6 and 7.

A pair of parallel and horizontally spaced-apart rails 15 and 16 project backwardly and horizontally from the lower back section of the dorsal plate, and are joined at their distal ends by a crossbar 17. A vertical panel 18 made of rigid material has a pair of spaced-apart apertures 19 and 20, each engaged over one of the rails 15 and 16. On each side of the knapsack, a set of strings 21, 22 and 23 have their distal ends attached along the flanged, lateral edge 24 of the panel 18. The strings pass through a series of holes 25 in the corresponding lateral edge of the dorsal plate 2 and are brought together at their proximal ends 26 to a section of a second belt assembly 27. The second belt runs parallel to the first belt and can be similarly cinched around the waist of the user. A first bag or container 28 made of soft and pliable material is sandwiched between the dorsal plate 2 and the panel 18. The front wall 29 of the first container may comprise part of the dorsal plate, or be completely independent from it. The back wall of the first container is preferably constituted by the panel 18. A large window 30 cut in the upper half of the panel 18 provides access into the first container 28. A lockable door 31 hingedly secured along one edge 32 to the panel 18 is used to securely close the window 30. A second smaller container 33 is detachably secured to the roof of the first container by a set of hook-and-vane fabric fasteners 34. The second container is also made of pliable material and has an opening flap 35 secured by a slide fastener 36 or the like. A third container 37 constituted by a rectangular netting secured over three sides to the back of the panel 18 can accommodate a variety of items. A closable pair of straps 38 along the unsecured edge of the netting can be adjustably tightened to secure the load.

It can now be understood that the back panel 18 can be shifted forward or backward along its supporting rails 15 and 16 to either compress or expand the width of the first container. Accordingly, any load held in the first container can be conveniently moved toward and pressed against the dorsal plate 2 by a tightening of the second belt assembly 27.

Figure 7:
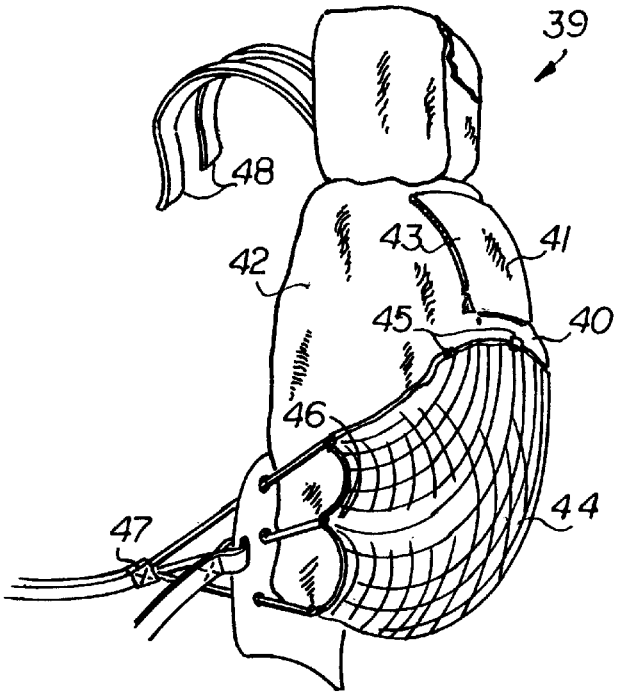
FIG. 7 is a perpspective view of an alternate embodiment of the invention.

In the alternate embodiment 39 of the invention illustrated in FIG. 7, the back panel 18 forming the back wall of the first container, has been replaced by a pliable wall 40 made of the same fabric material as the remainder of the bag. A foldable flap 41 in the upper half of the back wall provides access into the first container 42 and is sealed by a slide fastener 43. A netting 44 surrounds the lower half of the first container and is secured to it along its upper edge by a series of fasteners 45. The lateral edges 46 of the netting are attached to the same type of string and belt assembly 47 as was used in connection with the panel of the earlier described embodiment. Accordingly, the shifting of the load within the first container toward the lumbar area of the user is accomplished in the same manner as before by tightening of the string and belt assembly 47 around the user's waist. In this embodiment, the shoulder straps 11 and 12 of the previously-described embodiment are replaced by a pair of hooks 48 made from hard but flexible material that are shaped and dimensioned to closely ride over the user's shoulders.

While the preferred embodiments of the invention have been described, modifications can be made and other embodiments may be devised without departing from the spirit of the invention and the scope of the appended claims.

What is claimed is:

1. A knapsack securable to a user's back and waist which comprises:

a flexible dorsal plate shaped and dimensioned to intimately contact the user's dorsal area from below the shoulder plates to the pelvic region;

a plurality of straps for attaching said dorsal plate to the shoulders and waist area of the user including two cooperating straps, each being attached at one end to a lateral area of said dorsal plate, and being positioned and dimensioned to be cinched around said user's waist and to cause the flexible dorsal plate to close tightly around the lumbar area;

a first container mounted behind said dorsal plate, and including a back wall;

wherein said plurality of straps include a belt assembly shaped, dimensioned, and positioned to hold said container against said dorsal plate, said belt assembly further comprising means for shifting a load within said first container toward said dorsal plate; and wherein said means for shifting comprise a netting held against said back wall; and at least one pair of leads, each lead in said pair having a first end section secured to one of opposite sides of said netting.

2. The knapsack of claim 1, which further comprises:

a second container; and means for detachably securing said second container to said first container.

3. The knapsack of claim 2, wherein said second container is made of pliable sheet material.

4. The knapsack of claim 1, wherein each of said leads has a distal end section running parallel and along one of said straps shaped and dimensioned to wrap around the user's waist.

* * * * *